US005374022A

United States Patent [19]

Gilmer, Jr. et al.

[11] Patent Number: 5,374,022

[45] Date of Patent: Dec. 20, 1994

[54] TILTING MECHANISM FOR MARINE BOAT SEATING

[76] Inventors: Carl D. Gilmer, Jr., 782 Watson, Memphis, Tenn. 38111; Thomas R. Meador, 5874 Cedar Lake Dr., Walls, Miss. 38680

[21] Appl. No.: 48,304

[22] Filed: Apr. 19, 1993

[51] Int. Cl.[5] ..... B63B 17/00

[52] U.S. Cl. ..... 248/396; 248/656; 248/398

[58] Field of Search ..... 248/396, 397, 398, 394, 248/421, 656; 297/316, 325–328, 322, 344.13; 114/363

[56] References Cited

U.S. PATENT DOCUMENTS

| | | | |
|---|---|---|---|
| 1,916,346 | 7/1933 | Toncray et al. . | |
| 2,400,705 | 5/1946 | Morey et al. | 155/90 |
| 2,827,105 | 3/1958 | Brundage | 248/394 |
| 2,924,265 | 2/1960 | Himka | 248/394 |
| 3,006,594 | 10/1961 | Gruendler | 248/424 |
| 3,123,333 | 3/1964 | DeRose | 248/394 |
| 3,405,900 | 10/1968 | Robinson | 248/396 |
| 3,851,916 | 12/1974 | Quartullo | 114/363 X |
| 3,917,211 | 11/1975 | Daunderer et al. | 248/421 |
| 3,995,797 | 12/1976 | Knight | 248/184 |
| 4,372,521 | 2/1983 | Rampel et al. | 248/430 |
| 4,666,119 | 5/1987 | Dose | 248/421 |
| 4,995,580 | 2/1991 | Fujii | 248/421 |
| 5,112,018 | 5/1992 | Wahls | 248/394 |

FOREIGN PATENT DOCUMENTS

| | | | |
|---|---|---|---|
| 478055 | 10/1951 | Canada | 297/327 |
| 298089 | 4/1954 | Switzerland | 297/322 |
| 530315 | 12/1940 | United Kingdom | 248/397 |
| 749732 | 5/1956 | United Kingdom | 297/344.13 |

OTHER PUBLICATIONS

Sales Brochure entitled *America Goes Boating With B & M*, B & M Manufacturing Company, Inc., 7643 Old Lamar Avenue, Olive Branch, Miss. 38654.

*Primary Examiner*—Karen J. Chotkowski

*Attorney, Agent, or Firm*—Walker, McKenzie & Walker

[57] ABSTRACT

A marine boat seating tilting mechanism including an upper plate for being attached to the bottom of the seat portion of a marine boat seating; a lower plate for being attached to the top of a support member of the marine boat seating; pivot structure for pivotally attaching the upper plate and the lower plate together; and adjusting structure slidably attached to one of the plates and pivotally attached to the other of the plates for allowing the user of the tilting mechanism to manually adjust the tilt of the upper plate relative to the lower plate.

19 Claims, 2 Drawing Sheets

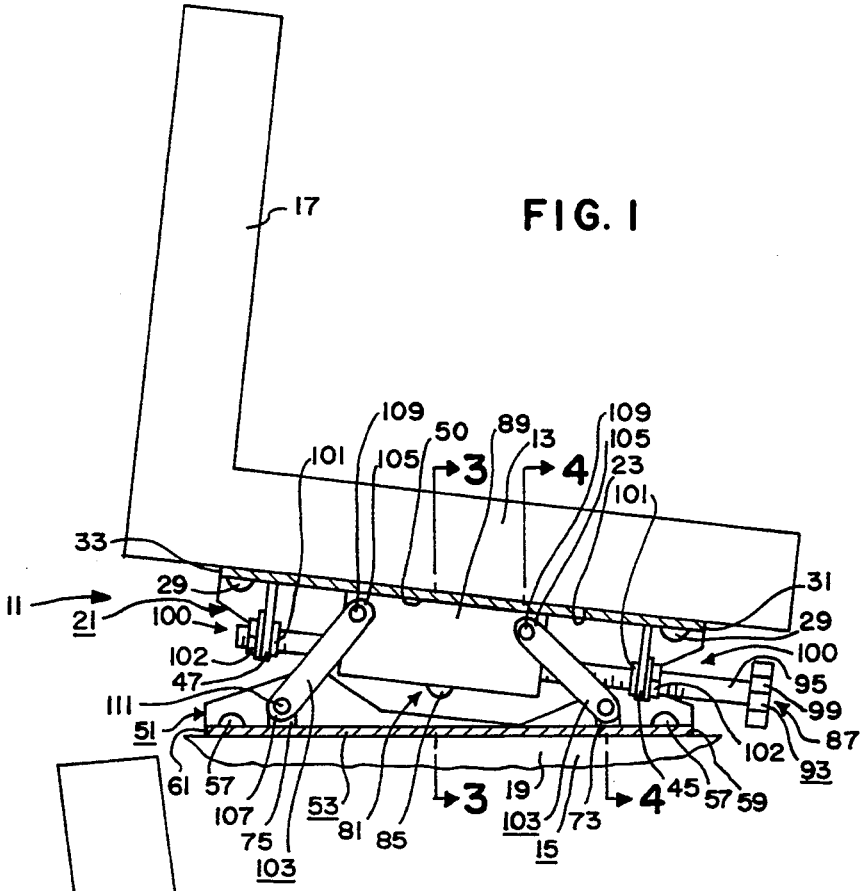
FIG. 1
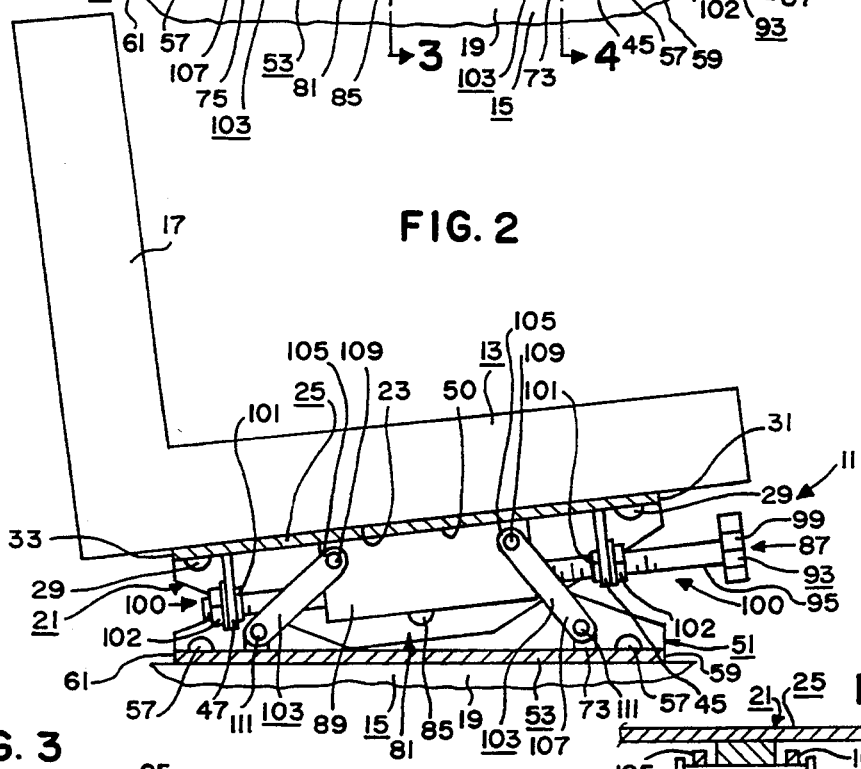
FIG. 2
FIG. 3
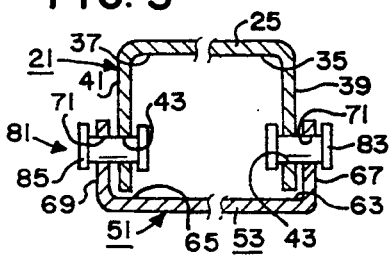
FIG. 4
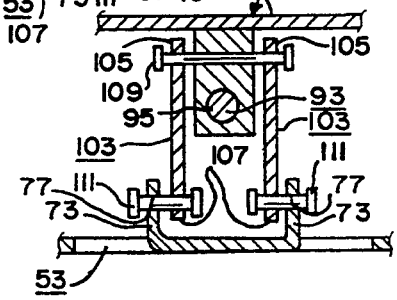

TILTING MECHANISM FOR MARINE BOAT SEATING

BACKGROUND OF THE INVENTION

1. Field of the Invention

The present invention relates, in general, to a mechanism which allows marine boat seating to be tilted.

2. Description of the Related Art

Typical marine boat seating includes at least a seat portion and support means for supporting the seat portion above the deck of a boat. The support means may include a pedestal or the like for supporting the seat portion a distance above the deck of the boat, or may include a simple attachment for attaching the seat portion to a standard bench-like portion of the boat, etc. Swivel means may be provided for allowing the seat portion to pivot. A backrest portion may be provided at the back edge of the seat portion, and arm rest portions may be provided adjacent the side edges of the seat portion. Such marine boat seating is disclosed in the sales brochure entitled America Goes Boating with B & M from B & M Manufacturing Company, Inc., 7643 Old Lamar Avenue, Olive Branch, Miss. 38654.

A common problem with all known prior art marine boat seating is that a person using such seating often becomes fatigued and/or uncomfortable, especially after using such seating for long periods of time. This is especially true for fishermen who may use such boat seating for many hours at a time and who may desire to remain as still as possible for safety reasons and/or so as not to frighten any fish that may be in the vicinity of the boat, etc.

Nothing in the known prior art discloses or suggests the present invention. More specifically, nothing in the known prior art discloses or suggest a marine boat seating tilting mechanism including an upper plate for being attached to the bottom of the seat portion of a marine boat seating; a lower plate for being attached to the top of the support means of the marine boat seating; pivot means for pivotally attaching the upper plate and the lower plate together; and adjusting means slidably attached to one of the plates and pivotally attached to the other of the plates for allowing the user of the tilting mechanism to manually adjust the tilt of the upper plate relative to the lower plate.

SUMMARY OF THE INVENTION

The present invention is directed toward providing a mechanism for allowing the user of marine boat seating to easily tilt the seating.

The tilting mechanism of the present invention includes, in general, an upper plate for being attached to the bottom of the seat portion of marine boat seating; a lower plate for being attached to the top of support means of the marine boat seating; pivot means for pivotally attaching the upper plate and the lower plate together; and adjusting means slidably attached to one of the plates and pivotally attached to the other of the plates for allowing the user of the tilting mechanism to manually adjust the tilt of the upper plate relative to the lower plate.

BRIEF DESCRIPTION OF THE DRAWINGS

FIG. 1 is a cross sectional view of the tilting mechanism of the present invention, shown in combination with marine boat seating and support means, and showing the tilting mechanism in a tilted forward position.

FIG. 2 is a cross sectional view similar to FIG. 1 but showing the tilting mechanism in a tilted back position.

FIG. 3 is a somewhat diagrammatic sectional view of the tilting mechanism of the present invention, showing the pivotal connection between upper and lower plates thereof, with portions thereof broken away for clarity.

FIG. 4 is a somewhat diagrammatic sectional view of the tilting mechanism of the present invention, showing the pivotal and sliding connection between the upper and lower plates and the adjusting means thereof, with portions thereof broken away for clarity.

DESCRIPTION OF THE PREFERRED EMBODIMENT

Figure 5:
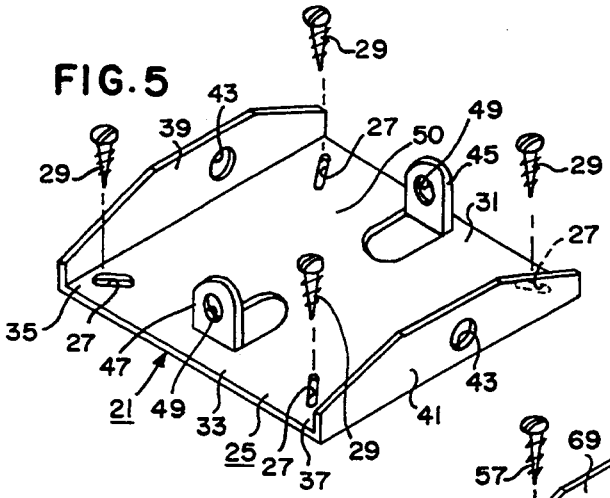
FIG. 5 is a perspective view of the upper plate of the tilting mechanism of the present invention, as taken from the bottom.
Figure 6:
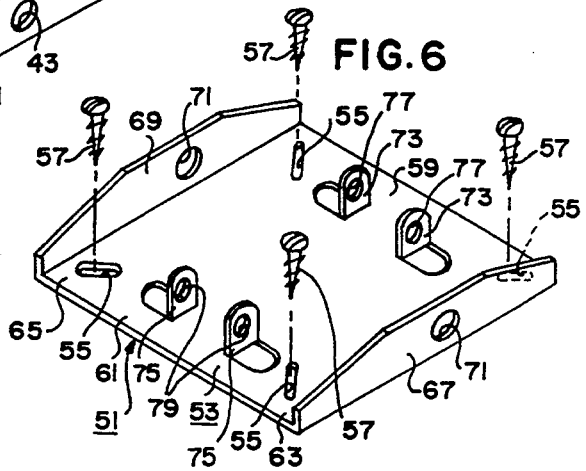
FIG. 6 is a perspective view of the lower plate of the tilting mechanism of the present invention, as taken from the top.
Figure 7:
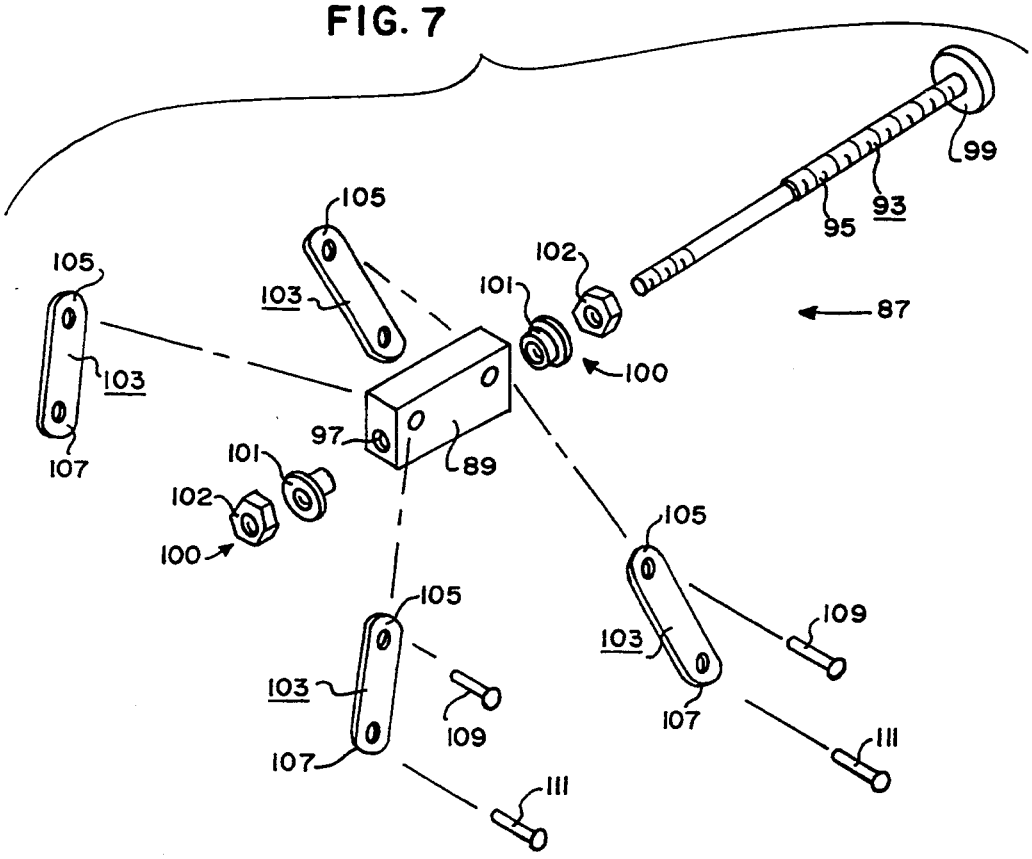
FIG. 7 is an exploded perspective view of the adjusting means of the tilting mechanism of the present invention.

The preferred embodiment of the tilting mechanism of the present invention is shown in FIGS. 1–7 and identified by the numeral 11. The tilting mechanism 11 is designed especially for use in combination with any typical marine boat seating.

Marine boat seating of various specific types, designs and constructions is well known to those skilled in the art. Typical marine boat seating has a seat portion 13 and support means 15 for supporting the seat portion 13 relative to the deck of a boat or the like Such marine boat seating may also include a backrest portion 17 extending upward from the back edge of the seat portion 13 as clearly shown in FIGS. 1 and 2. In addition, marine boat seating may include arm rest portions (not shown) positioned adjacent the side edges of the seat portion 13 as will now be apparent to those skilled in the art The support means 15 may include a typical pedestal or the like having a first or upper end 19 for normally being attached to the bottom of the seat portion 13 and having a second or lower end (not shown) for being mounted to the deck of a boat or the like. Such marine boat seating is disclosed in the sales brochure entitled America Goes Boating With B & M from B & M Manufacturing Company, Inc., 7643 Old Lamar Avenue, Olive Branch, Miss. 38654.

The tilting mechanism 11 includes an upper plate 21 for being attached to the bottom 23 of the seat portion 13. The upper plate 21 preferably includes a substantially flat main body 25 for being fixedly attached to the bottom 23 of the seat portion 13. More specifically, the main body 25 preferably includes a plurality of slots 27 therethrough for allowing screws 29 to be used to fixedly attach the upper plate 21 to the bottom 23 of the seat portion 13.

The main body 25 preferably has a front edge 31, a rear edge 33, a right side edge 35 and a left side edge 37. The main body 25 is preferably substantially rectangular in plan, with a length of approximately 7 inches (approximately 177.8 millimeters) and a width of approximately 6.75 inches (approximately 171.45 millimeters). The main body 25 may have four slots 27 therethrough with each slot 27 aligned (s10 H with another slot 27 along a line that extends diagonally across the main body 25, through opposite corners thereof with each pair of slots 27 spaced from one another approximately 7.25 inches (approximately 184.15 millimeters). Such an arrangement assures that the slots will align with the standard spacing of fastening apertures normally provided in or used for the bottom 23 of the seat portion 13 of marine boat seating as will now be apparent to those skilled in the art.

The upper plate 21 preferably includes a right side wall 39 extending downward from the right side edge 35 of the main body 25, and a left side wall 41 extending downward from the left side edge 37 of the main body 25. Each side wall 39, 41 preferably has an aperture 43 therethrough substantially midway between the opposite ends thereof and aligned with the aperture 43 through the opposite side wall 39, 41.

The upper plate 21 preferably includes a first or forward flange or tab 45 extending downward from the main body 25 at a point adjacent the front edge 31 and substantially midway between the right and left side edges 35, 37. The upper plate 21 preferably includes a second or rearward flange or tab 47 extending downward from the main body 25 at a point adjacent the rear edge 33 and substantially midway between the right and left side edges 35, 37. Each tab 45, 47 preferably has an aperture 49 therethrough aligned with the aperture 49 in the opposite tab 45, 47. At least a portion 50 of the bottom of the upper plate 21 between the forward and rearward tabs 45, 47 is preferably substantially flat.

The upper plate 21 may be constructed in various manners, out of various materials and in various specific designs, etc., as will now be apparent to those skilled in the art. Thus, for example, the upper plate 21 may be pressed and bent out of sheet metal or the like in the general design shown in the drawings.

The tilting mechanism 11 includes a lower plate 51 for being attached to the top or upper end 19 of the support means 15. The lower plate 51 preferably includes a substantially flat main body 53 for being fixedly attached to the top or upper end 19 of the support means 15 substantially at the Center thereof. More specifically, the main body 53 preferably includes a plurality of slots 55 therethrough for allowing screws 57 to be used to fixedly attach the lower plate 51 to the top or upper end 19 of the support means 15.

The main body 53 preferably has a front edge 59, a rear edge 61, a right side edge 63 and a left side edge 65. The main body 53 is preferably substantially rectangular in plan, with a length of approximately 7 inches (approximately 177.8 millimeters) and a width of approximately 6.75 inches (approximately 171.45 millimeters), The main body 53 may have four slots 55 therethrough with each slot 55 aligned with another slot 55 along a line that extends diagonally across the main body 53, through opposite corners thereof with each pair of slots 55 spaced from one another approximately 7.25 inches (approximately 184.15 millimeters). Such an arrangement assures that the slots 55 will align with the standard spacing of fastening apertures normally provided in or used for the top or upper end 19 of typical support means 15 of marine boat seating as will now be apparent to those skilled in the art.

The lower plate 51 preferably includes a right side wall 67 extending upward from the right side edge 63 of the main body 53, and a left side wall 69 extending upward from the left side edge 65 of the main body 53. Each side wall 67, 69 preferably has an aperture 73 therethrough substantially midway between the opposite ends thereof and aligned with the aperture 71 through the opposite side wall 67, 69.

The lower plate 51 preferably includes an opposed pair of first or forward flanges or tabs 73 extending upward from the main body 53 at a point substantially adjacent the front edge 59. The lower plate 51 preferably includes an opposed pair of second or rearward flanges or tabs 75 extending upward from the main body 53 at a point substantially adjacent the rear edge 61. Each tab 73 preferably has an aperture 77 therethrough aligned with the aperture 77 in the opposite tab 73. Each tab 75 preferably has an aperture 79 therethrough aligned with the aperture 79 in the opposite tab 75.

The lower plate 51 may be constructed in various manners, out of various materials, and in various specific designs, etc., as will now be apparent to those skilled in the art. Thus, for example, the lower plate 51 may be pressed and bent out of sheet metal or the like in the general design shown in the drawings.

The tilting mechanism 11 includes pivot means 81 for pivotally attaching the upper plate 21 and the lower plate 51 together. The pivot means 81 preferably includes a first or right side pivot means 83 for extending through the aperture 43 in the right side wall 39 of the upper plate 21 and through the aperture 71 in the right side wall 67 of the lower plate 51 for pivotally attaching the right side wall 39 of the upper plate 21 and the right side wall 67 of the lower plate 51 together. The pivot means 81 preferably includes a second or left side pivot means 85 for extending through the aperture 43 in the left side wall 41 of the upper plate 21 and through the aperture 71 in the left side wall 69 of the lower plate 51 for pivotally attaching the left side wall 41 of the upper plate 21 and the left side wall 69 of the lower plate 51 together. Each pivot means 83, 85 may consist simply of a typical rivet or the like as will now be apparent to those skilled in the art.

The tilting mechanism 11 includes adjusting means 87 slidably attached to one plate 21, 51 and pivotally attached to the other plate 2l, 51 for allowing the user of the tilting mechanism 11 to manually adjust the tilt of the upper plate 21 relative to the lower plate 51. The adjusting means 87 preferably includes an adjusting block 89 for slidably engaging the substantially flat bottom portion 50 of the upper plate 21. The adjusting means 87 preferably includes link means for pivotally attaching the adjusting block 89 to the lower plate 51 in such a manner that back and forth sliding movement of the adjusting block 89 on the substantially flat bottom portion 50 of the upper plate 21 will cause the upper plate 21 to tilt back and forth relative to the lower plate 51 about the pivot means 81.

The adjusting means 87, preferably includes manual means 93 for allowing the user of the tilting mechanism 11 to manually slide the adjusting block 89 back and forth on the substantially flat bottom portion 50 of the upper plate. The manual means 93 preferably includes rod means, e.g., a shaft member 95, rotatably coupled to-the adjusting block 89 in such a manner that the adjusting block 89 will slide back and forth when the shaft member 95 is rotated. The shaft member 95 preferably has external screw threads thereon and the adjusting block 89 preferably has a threaded aperture 97 therethrough for receiving the threaded shaft member 95 in such a manner that rotation of the threaded shaft member 95 will cause the adjusting block 89 to move back and forth on the threaded shaft member 95. The shaft member 95 preferably extends through the apertures 49 in the tabs 45, 47 of the upper plate 21 with the adjusting block 89 positioned between the two tabs 45, 47, to thereby slidably attach the adjusting block 89 to the upper plate 21. A handle 99 is preferably attached to the forward end of the shaft member 95 for allowing the user of the tilting mechanism 11 to easily rotate the shaft member 95 The tilting mechanism 11 preferably includes securing means 100 for rotatably securing the shaft member 95 to the upper plate 21. A pair of securing means 100 are preferably attached to the shaft member 95 for coacting with the tabs 45, 47 of the upper plate 21 and for rotatably securing the adjusting block 89 and the shaft member 95 to the upper plate 21 as will now be apparent to those skilled in the art. Each securing means 100 may consist of a threaded bushing member 101 for being screwed onto the shaft member 95 and for rotatably engaging the aperture 49 in a respective tab 45, 47 of the upper plate 21, and a jam or lock nut 102 for securing the respective bushing member 101 to the shaft member 95 as will now be apparent to those skilled in the art.

The link means preferably includes a plurality of link members 103 extending between the lower plate 51 and the adjusting block 89 for pivotally attaching the adjusting block 89 to the lower plate 51. Each link member 103 preferably consists of an elongated, substantially rigid bar or the like having a first end 105 for being pivotally attached to the adjusting block 89 and having a second end 107 for being pivotally attached to one of the tabs 73, 75 of the lower plate 51. Thus, bolts means 109 or the like may be provided for pivotally attaching the first end 105 of each link member 103 to the adjusting block 89 as will now be apparent to those skilled in the art. Bolt means 111 may be provided for pivotally attaching the second end 107 of each link member 103 to the respective tab 73, 75 through the respective aperture 77, 79 as will now be apparent to those skilled in the art, The use and operation of the tilting mechanism 11 is quite simple. With the various elements of the tilting mechanism 11 attached to one another, to the seat portion of the boat seating, and the upper end 19 of the support means 15 as hereinabove described, a person sitting on the seat portion 13 can easily adjust the tilt of the seat portion 13, etc., by merely grasping and rotating the handle 99 to thereby cause the adjusting block 89 to move back and/or forth on the shaft member 95, thereby causing the upper plate 21 to rotate about the pivot means 83, 85 and causing the seat portion 13, etc to tilt. It should be noted that by positioning the handle 99 adjacent the front of the seat portion 13, a person can adjust the tilt of the seat portion 13 while remaining thereon. However, the person does not, of course, have to remain on or sit on the seat portion 13 to adjust the tilt thereof.

Although the present invention has been described and illustrated with respect to a preferred embodiment and a preferred use therefor, it is not to be so limited since modifications and changes can be made therein which are within the full intended scope of the invention.

I claim:

1. A tilting mechanism for use with marine boat seating of the type having a seat portion and a support member for supporting the seat portion; said tilting mechanism comprising:

a) an upper plate for being attached to the bottom of the seat portion of a marine boat seating;

b) a lower plate for being attached to the top of a support member of the marine boat seating;

c) pivot means for pivotally attaching said upper plate and said lower plate together about a fixed axis relative to said upper and lower plates; and d) adjusting means including an adjusting block in slidable engagement contact with one of said plates and said adjustment means being pivotally attached to the other of said plates for allowing the user of said tilting mechanism to manually adjust the tilt of said upper plate relative to said lower plate.

2. The tilting mechanism of claim 1 in which said upper plate has a substantially flat bottom side portion; in which said adjusting block is in slidable engagement contact with said substantially flat bottom side portion of said upper plate; and in which is included link means for pivotally attaching said adjusting block to said lower plate in such a manner that back and forth sliding movement of said adjusting block on said substantially flat bottom side portion of said upper plate will cause said upper plate to tilt back and forth relative to said lower plate about said fixed axis.

3. The tilting mechanism of claim 2 in which said adjusting means includes manual means for allowing the user of said tilting mechanism to manually slide said adjusting block back and forth on said substantially flat bottom side portion of said upper plate.

4. The tilting mechanism of claim 3 in which said manual means includes rod means rotatably coupled to said upper plate and to said adjusting block for causing said adjusting block to move back and forth relative to said substantially flat bottom of said portion of said upper plate when rotated.

5. The tilting mechanism of claim 4 in which said upper plate has a downwardly extending forward tab and a downwardly extending rearward tab; each of said tabs of said upper plate having an aperture thereof for allowing said rod means of said manual means of said adjusting means to extend therethrough.

6. The tilting mechanism of claim 5 in which is included securing means for rotatably securing said rod means of said manual means of said adjusting means to said upper plate.

7. The tilting mechanism of claim 6 in which said link means includes a plurality of link members extending between said lower plate and said adjusting block of said adjusting means for pivotally attaching said adjusting block to said lower plate.

8. A tilting mechanism for use with marine boat seating of the type having a seat portion and a support member for supporting the seat portion; said tilting mechanism comprising:

a) an upper plate for being attached to the bottom of the seat portion of a marine boat seating; said upper plate having a substantially flat bottom side portion, a downwardly extending right side wall, and a downwardly extending left side wall;

b) a lower plate for being attached to the top of a support member of the marine boat seating; said lower plate having an upwardly extending right side wall and an upwardly extending left side wall, said lower plate having a length of approximately 7 inches and a width of approximately 6.75 inches, and said lower plate having slots therein for aligning with fastening means on the support member:

c) pivot means for pivotally attaching said upper plate and said lower plate together about a fixed axis; said pivot means including a right side pivot means for pivotally attaching said right side wall of said upper plate and said right side wall of said lower plate together; said pivot means including a left side pivot means for pivotally attaching said left side wall of said upper plate and said left side wall of said lower plate together;

d) adjusting means slidably attached to one of said plates and pivotally attached to the other of said plates for allowing the user of said tilting mechanism to manually adjust the tilt of said upper plate relative to said lower plate; said adjusting means including an adjusting block in slidable engagement contact with said substantially flat bottom side portion of said upper plate; said adjusting means including manual means for allowing the user of said tilting mechanism to manually slide said adjusting block back and forth in slidable engagement contact with said substantially flat bottom side portion of said upper plate; and e) link means for pivotally attaching said adjusting block to said lower plate in such a manner that back and forth sliding movement of said adjusting block on said substantially flat bottom side portion of said upper plate will cause said upper plate to tilt back and forth relative to said lower plate about said fixed axis.

9. The tilting mechanism of claim 8 in which said manual means includes rod means rotatably coupled to said upper plate and to said adjusting block for causing said adjusting block to move back and forth relative to said substantially flat bottom of said portion of said upper plate when rotated.

10. The tilting mechanism of claim 9 in which said upper plate has a downwardly extending forward tab and a downwardly extending rearward tab; each of said tabs of said upper plate having an aperture thereof for allowing said rod means of said manual means of said adjusting means to extend therethrough.

11. The tilting mechanism of claim 10 in which is included securing means for rotatably securing said rod means of said manual means of said adjusting means to said upper plate.

12. The tilting mechanism of claim 11 in which said link means includes a plurality of link members extending between said lower plate and said adjusting block of said adjusting means for pivotally attaching said adjusting block to said lower plate.

13. In combination:

a) marine boat seating having a seat portion and a support member for supporting the seat portion;

b) a tilting mechanism for allowing the user of said marine boat seating to tilt said seat portion; said tilting mechanism comprising:

i) an upper plate for being attached to the bottom of said seat portion of said marine boat seating;

ii) a lower plate for being attached to the top of said support member of said marine boat seating;

iii) pivot means for pivotally attaching said upper plate and said lower plate together about a fixed axis relative to said upper and lower plates; and iv) adjusting means including an adjusting block in slidable engagement contact with one of said plates and said adjustment means being pivotally attached to the other of said plates for allowing the user of said tilting mechanism to manually adjust the tilt of said upper plate relative to said lower plate about said fixed axis.

14. The combination of claim 13 in which said upper plate of said tilting mechanism has a substantially flat bottom side portion; in which said adjusting block is in slidable engagement contact with said substantially flat bottom side portion of said upper plate; and in which said tilting mechanism includes link means for pivotally attaching said adjusting block to said lower plate in such a manner that back and forth sliding movement of said adjusting block on said substantially flat bottom side portion of said upper plate will cause said upper plate to tilt back and forth relative to said lower plate.

15. The combination of claim 14 in which said adjusting means of said tilting mechanism includes manual means for allowing the user of said combination to manually slide said adjusting block back and forth on said substantially flat bottom side portion of said upper plate.

16. The combination of claim 15 in which said manual means of said tilting mechanism includes rod means rotatably coupled to said upper plate and to said adjusting block for causing said adjusting block to move back and forth relative to said substantially flat bottom of said portion of said upper plate when rotated, said rod means being parallel to said upper plate.

17. The combination of claim 16 in which said upper plate of said tilting mechanism has a downwardly extending forward tab and a downwardly extending rearward tab; each of said tabs of said upper plate having an aperture thereof for allowing said rod means of said manual means of said adjusting means to extend therethrough.

18. The combination of claim 17 in which said tilting mechanism includes securing means for rotatably securing said rod means of said manual means of said adjusting means to said upper plate.

19. The combination of claim 18 in which said link means of said tilting mechanism includes a plurality of link members extending between said lower plate and said adjusting block of said adjusting means for pivotally attaching said adjusting block to said lower plate.

* * * * *